US008172336B2

(12) United States Patent
Boucherie

(10) Patent No.: US 8,172,336 B2
(45) **Date of Patent: *May 8, 2012**

(54) TUFT PICKING DEVICE FOR A BRUSH MAKING MACHINE

(75) Inventor: Bart Gerard Boucherie, Izegem (BE)

(73) Assignee: Firma G. B. Boucherie N.V., Izegem (DE)

( * ) Notice: Subject to any disclaimer, the term of this patent is extended or adjusted under 35 U.S.C. 154(b) by 237 days.

This patent is subject to a terminal disclaimer.

(21) Appl. No.: 12/589,024

(22) Filed: Oct. 16, 2009

(65) Prior Publication Data

US 2010/0066154 A1 Mar. 18, 2010

Related U.S. Application Data

(63) Continuation-in-part of application No. 11/255,302, filed on Oct. 21, 2005, now Pat. No. 7,635,169.

(30) Foreign Application Priority Data

Oct. 22, 2004 (DE) ..... 20 2004 016 409 U

(51) Int. Cl.
*A46D 1/08* (2006.01)

(52) U.S. Cl. ..... 300/7; 300/2

(58) Field of Classification Search ..... 300/2, 5, 300/7, 9, 21

See application file for complete search history.

(56) References Cited

U.S. PATENT DOCUMENTS

| | | | | |
|---|---|---|---|---|
| 521,630 | A | 6/1894 | Besson | |
| 800,668 | A | 10/1905 | Nielson | |
| 1,641,686 | A | 9/1927 | Nillson | |
| 1,664,424 | A | 4/1928 | Jobst | |
| 2,105,334 | A | 1/1938 | Scully et al. | |
| 2,349,532 | A | 5/1944 | West | |
| 2,621,079 | A | 12/1952 | Carlson | |
| 3,072,440 | A | 1/1963 | Norris | |
| 6,290,303 | B1 | 9/2001 | Boucherie | |
| 7,635,169 | B2 * | 12/2009 | Boucherie | 300/7 |

FOREIGN PATENT DOCUMENTS

| | | |
|---|---|---|
| DE | 19 38 937 | 2/1971 |
| DE | 40 40 297 | 6/1992 |
| EP | 1 649 778 A2 | 4/2006 |
| GB | 1311974 | 3/1973 |
| JP | 2003/169719 | 6/2003 |

* cited by examiner

*Primary Examiner* — Gary Graham
(74) *Attorney, Agent, or Firm* — Stuart J. Friedman

(57) ABSTRACT

A tuft picker device for a brush making machine has a bristle magazine for holding a supply of loose bristles and a tuft picker having a tuft picking notch being movable past an open side of the bristle magazine in a working stroke. A shield member is adapted to be shifted across the tuft picker notch to change the effective depth thereof. The shield member can be adjusted by an adjusting device in each working stroke in order to vary the effective depth of the tuft picking notch from one working stroke to the next to change the size of a tuft engaged in the notch.

17 Claims, 4 Drawing Sheets

TUFT PICKING DEVICE FOR A BRUSH MAKING MACHINE

FIELD OF THE INVENTION

The present invention relates to a tuft picking device for a brush making machine.

BACKGROUND OF THE INVENTION

Tuft pickers serve to remove individual tufts of bristles from a bristle magazine in succession in order to feed them to a brush making machine. The tuft picker essentially is a slider which reciprocates in a sliding motion at an open side of the bristle magazine and has a tuft picking notch in which the bristles forming the tuft will collect during the sliding motion past the bristle magazine. The tuft picker transports each separated tuft of bristles to a processing station, for example a tufting tool, and is then moved back to the bristle magazine for separating the next tuft of bristles. With each working stroke of the tuft picker, a tuft of bristles is separated in this way.

The profile of the tuft picking notch dictates the quantity of the bristles that are separated in each working stroke of the tuft picker. In order that a single tuft picker device can be used for separating tufts having different quantities of bristles, the effective depth of the tuft picking notch can be varied by laterally covering part of the profile with a shield member. Rather than the bottom of the tuft picking notch, it is then the shield member that defines the depth up to which the bristles can penetrate into this notch. A tuft picking device including a tuft picking notch having an adjustable effective depth is disclosed, e.g., in DE 40 40 297 C2. A device of this type is suitable for separating bristle tufts of different cross-sections for different brushes.

A knot picking machine is disclosed in U.S. Pat. No. 1,641,686 having a member is provided on the tuft picker, which can be moved transversely to the slot so as to regulate the effective area of the slot for receiving bristles. The member is substantially semi-circular and is fixedly mounted with a screw.

In connection with modern brushes, in particular toothbrushes, it has been desirable to have bristle tufts of different cross-sectional shapes and sizes that are arranged next to each other in a bristle field. Brushes of this kind are complicated to produce since the high-speed, efficiently operating brush making machines available can not be used for making them.

SUMMARY OF THE INVENTION

The invention provides a tuft picking device that is capable of varying the effective depth of the tuft picking notch in each working stroke while keeping abreast of modern high-speed brush making machines. The tuft picking device according to the invention for a brush making machine has a bristle magazine for holding a supply of loose bristles, a tuft picker having a tuft picking notch being movable past an open side of the bristle magazine in a working stroke. At least one shield member is adapted to be shifted across the profile of the tuft picking notch to thereby change the effective depth thereof. The shield member is displaced by way of a constrained guidance using an adjusting device. Actuating drives are available which can perform the required small adjusting stroke rapidly, precisely and reproducibly. An important factor here is a rigid coupling between the shield member and the actuating drive.

It was found to be of advantage to use a crank drive including a rotary drive that is fixed to the machine frame and has a servomotor and includes a crank arm. The crank arm is articulated with a connecting rod which in turn is articulated with a stirrup that is adapted to be shifted in translation on the machine frame. Through the stirrup, the adjusting stroke is rigidly transmitted to the shield member.

The tuft picker may be curved along a circular arc and be adapted to be pivoted about a fixed axis in a conventional fashion. The shield member then is a rigid rail which is curved in the shape of a circular arc and is engaged by the adjusting device. Alternatively, the actuating drive engages a curved rigid guide which is radially displaceable in relation to the axis and has a cam follower guided in a constrained fashion therein which actuates the shield member.

In another aspect of the invention, the actuating drive comprises a follower member pivotally mounted on the tuft picker itself. The follower member engages with a guide having a guide surface which determines the deflection or pivot angle of the follower. The follower in turn is coupled to a lever mounted on the tuft picker, a portion of the lever defining the shield member. Rotation of the follower member then causes rotation of the lever, which in turn moves the shield member across the notch to vary the effective depth of the notch. This embodiment has the advantage that the actuating drive components are integrated with or into the tuft picker itself and no separate mounting means are necessary to fix the actuating drive to the machine frame.

BRIEF DESCRIPTION OF THE DRAWINGS

Further features and advantages of the invention will be apparent from the following description of several embodiments with reference to the accompanying drawings in which.

DESCRIPTION OF THE PREFERRED EMBODIMENT

Figure 1:
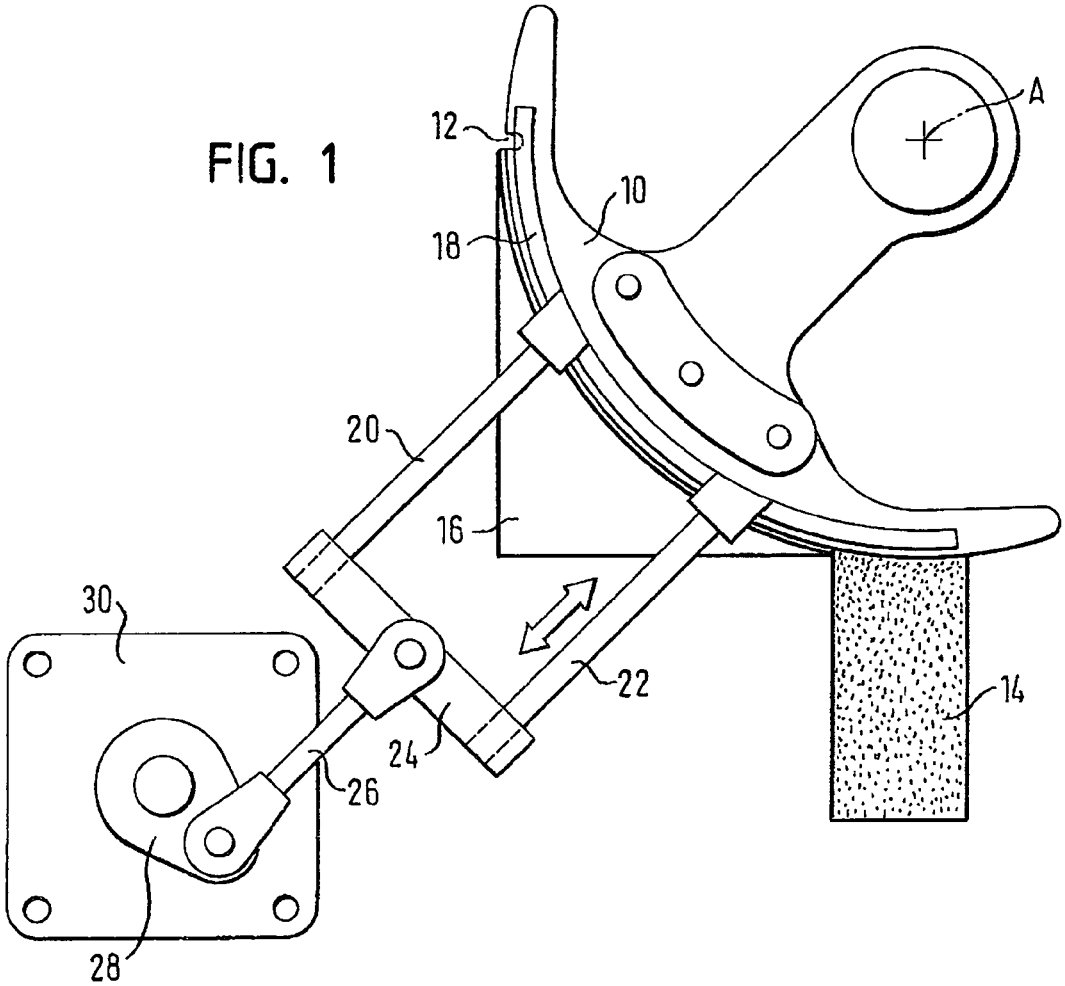
FIG. 1 shows a diagrammatic top view of a tuft picking device having an actuating drive for controlling a shield rail which has the shape of a circular arc and is used for varying the effective depth of a tuft picking notch in a tuft picker.

The embodiment of the tuft picking device as shown in FIG. 1 has a tuft picker 10 that is curved in the shape of a circular arc and can be pivoted about an axis A which is fixed in relation to the machine frame of a brush making machine. The tuft picker 10 has in its peripheral surface a tuft picking notch 12, which is illustrated greatly enlarged in FIG. 2. The peripheral surface of the tuft picker 10 is in contact with an open side of a bristle magazine 14 which has parallel bristles, cut to length, loosely held therein. The tuft picker 10 can be pivoted about the axis A by in working stroke in which the tuft picking notch 12 is moved over the open side of the bristle magazine 14 so that the tuft picking notch fills with bristles from the bristle magazine 14. During the return movement of the tuft picker 10, the bristles that have been removed are held in place in the notch 12 by a screen 16 which is in contact with the periphery of the tuft picker 10. FIG. 1 shows the tuft picker 10 in a delivery position in which the separated tuft of bristles is transferred from the notch 12 to a workstation of a brush making machine.

Figure 2:
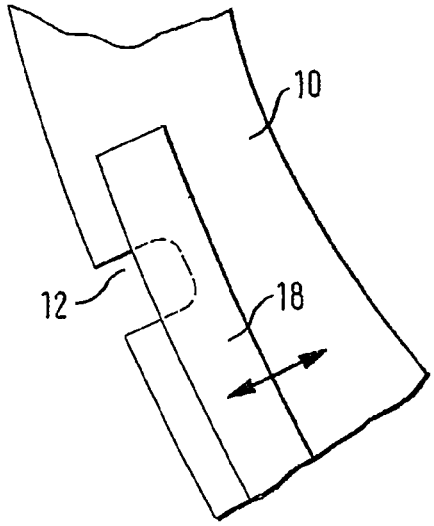
FIG. 2 shows a view of a detail from FIG. 1 on an enlarged scale.

For varying the effective depth of the tuft picking notch 12, a shield or covering member in the form of a rigid rail 18 is provided which is curved in the shape of a circular arc. The rail 18 is connected to a rigid stirrup which consists of a pair of parallel bars 20, 22 and a web 24 connecting them. The stirrup, and the rail 18 along with it, are articulatedly connected via the web 24 to a connecting rod 26 which in turn is articulatedly connected to a crank arm 28 of a rotary drive 30. The rotary drive 30 is mounted on the machine frame of the brush making machine. As indicated by a double arrow in FIG. 1, the bars 20, 22 of the rigid stirrup are mounted to be displaceable in the radial direction in relation to the axis A. Together with the crank drive made up of the crank arm 28 and the connecting rod 26, the rotary drive 30 forms an actuating drive for moving the rail 18 via the rigid stirrup which is formed by the bars 20, 22 and the web 24. This actuating drive, the rotary drive of which is preferably constituted by a servomotor, is capable of displacing the rigid rail 18 in relation to the tuft picker 10, as indicated by a double arrow in FIG. 2, and of doing so very rapidly, very precisely and in a well reproducible manner. This displacement causes the rail 18 to slide transversely across the profile of the tuft picking notch 12 in order to change the effective depth thereof. FIG. 2 shows the rail 18 in a middle position, in which the overall depth of the notch 12 is approximately reduced by half.

Figure 3:
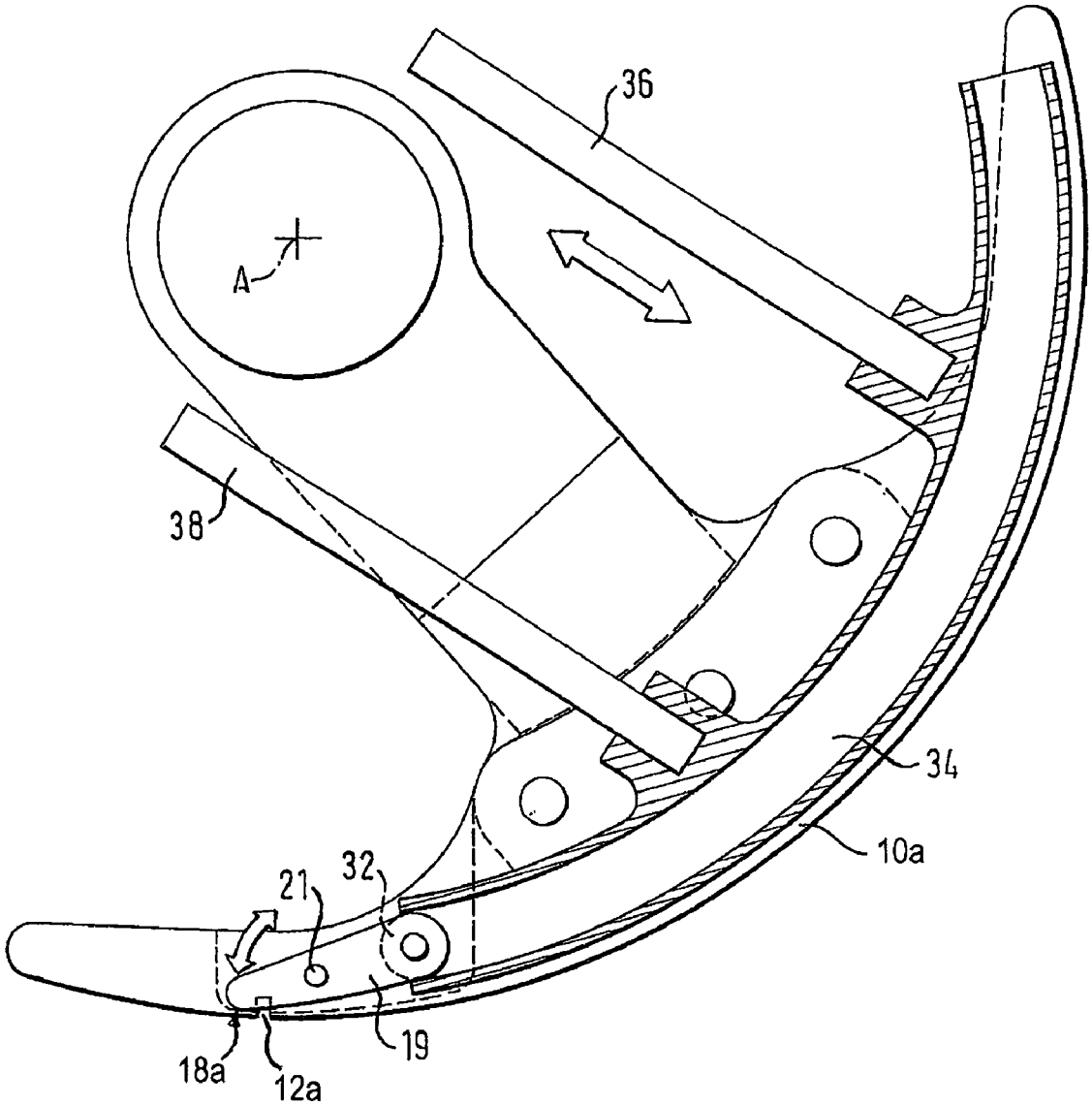
FIG. 3 shows a second embodiment of the tuft picking device comprising a lever mounted on the tuft picker.

In the tuft picking device according to FIG. 3, the tuft picker 10*a* cooperates with a shield member 18*a* that is formed by one end of a two-armed lever 19 which is mounted at the tuft picker 10*a* for pivoting about a pin 21. The opposite end of the two-armed lever 19 carries a cam follower in the form of a roller 32. The roller 32 is guided in a guide 34 which is curved so as to correspond to the shape of the tuft picker 10*a* and is mounted on the machine frame so as to be radially displaceable in relation to the axis A of the tuft picker 10*a*. The guide 34 is coupled to an actuating drive by means of rigid bars 36, 38; the actuating drive may be implemented in the same way as in the embodiments described above. As the tuft picker 10*a* performs a pivoting movement, the roller 32 is guided in a constrained fashion in the guide 34. The radius to which the guide 34 is set in relation to the axis A dictates the pivoting position of the two-armed lever 19. The pivoting position of the two-armed lever 19 in turn determines the level of the shield member 18*a* relative to the bottom of the profile of the tuft picking notch 12*a*. Since the radial adjustment of the guide 34 causes a change in the pivoting position of the lever 19 and thus in the position of the shield member 18*a*, as a result the effective depth of the tuft picking notch 12*b* can be varied.

Figure 4:
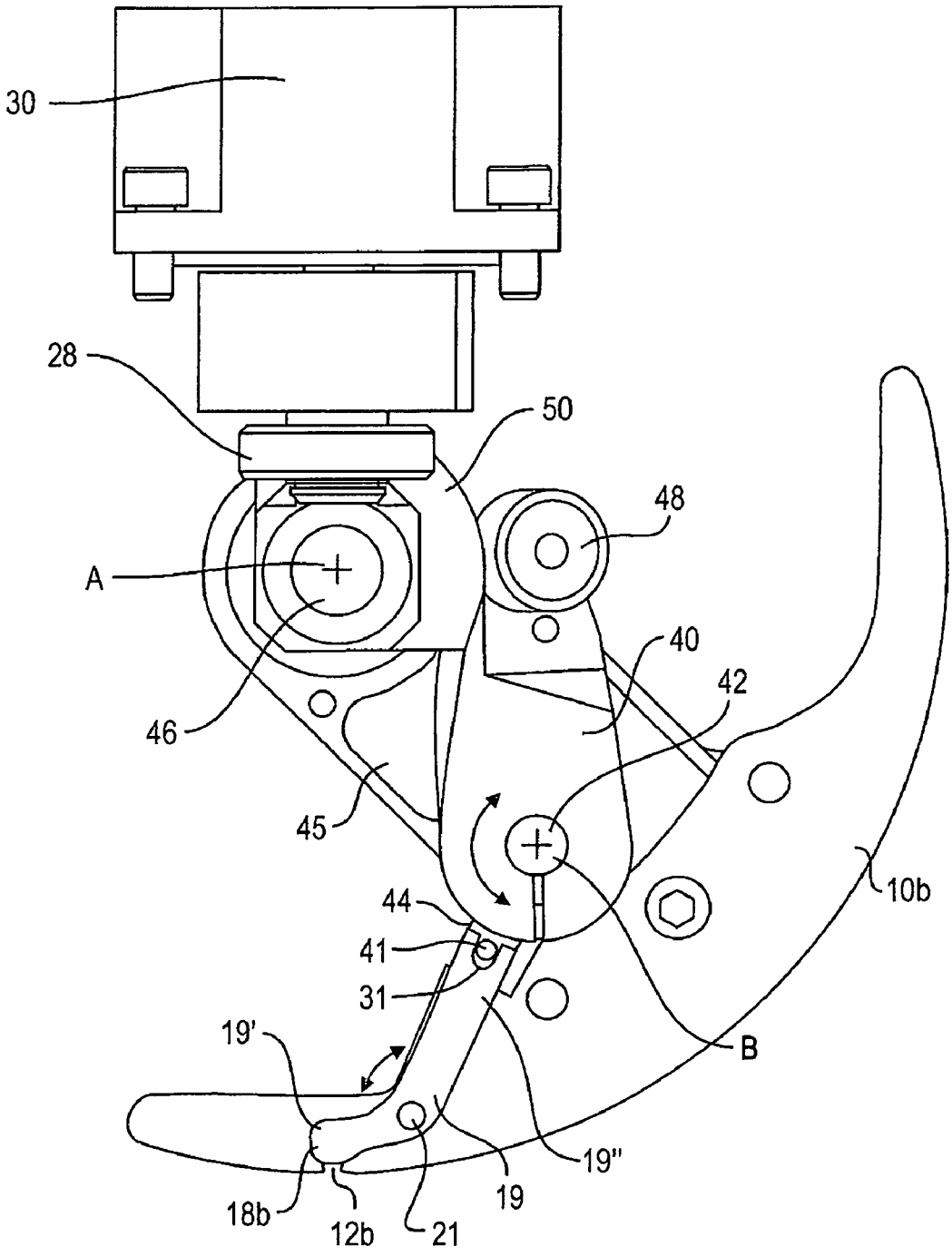
FIG. 4 shows a top view of a third embodiment of the tuft picking device by which the shield member is adjusted to a follower member engaging a guide.
Figure 5:
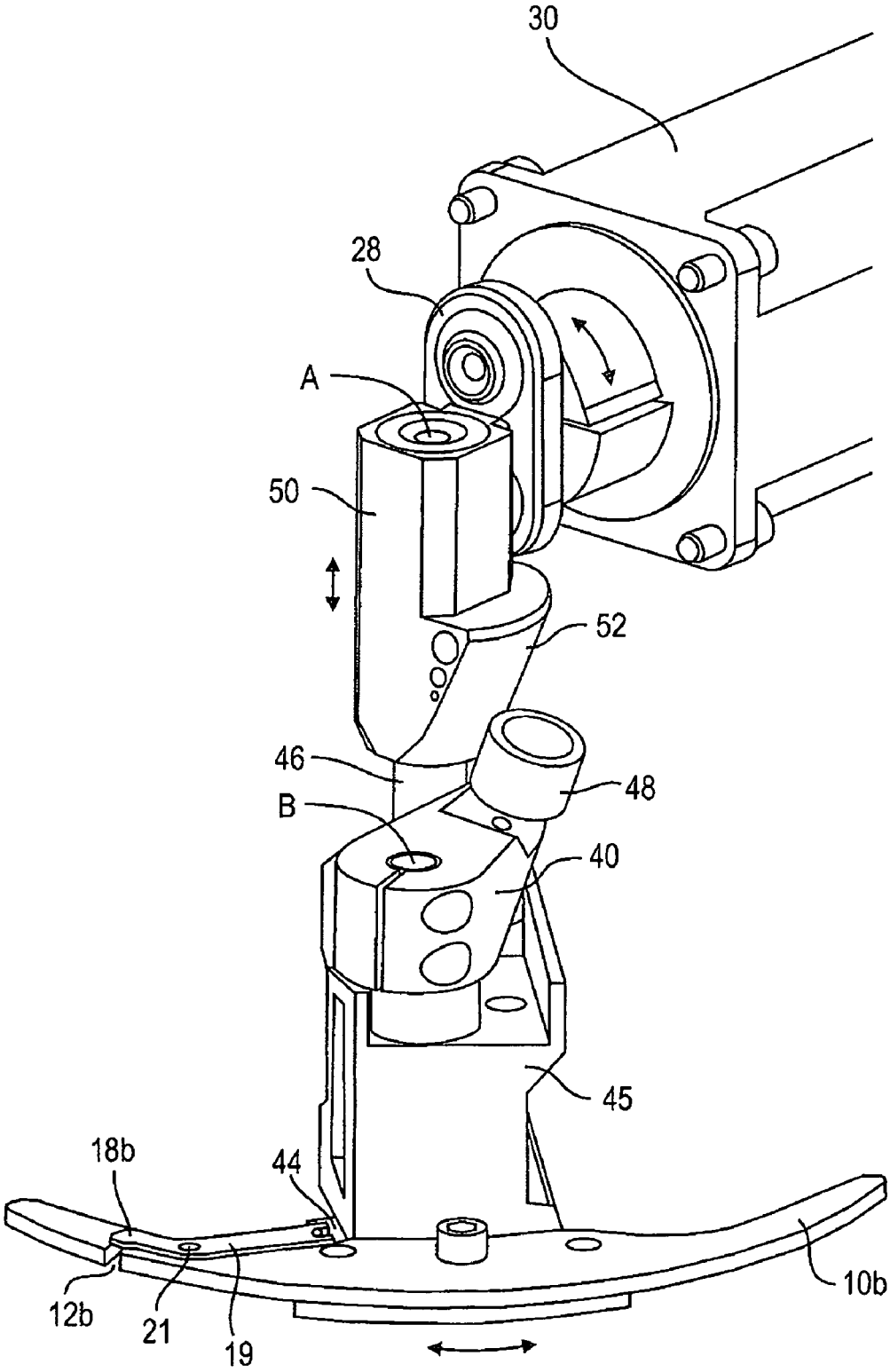
FIG. 5 shows a perspective view of the embodiment of FIG. 4.

FIGS. 4 and 5 illustrate a further embodiment of the present invention by which the actuating drive components are provided on or integrated with the structure of the tuft picker itself. The tuft picker 10*b* in this embodiment is formed as a circular arc segment which pivots about an axis A. The tuft picker 10*b* is supported by a carrier 45 which is coupled to the shaft 46. The center line of the shaft 46 defines the pivot axis A of the tuft picker. In this embodiment, the shield member 18*b* is formed as a first portion 19' of a lever 19 mounted through a pivot pin 21 on the tuft picker 10*b*. A second portion 19" of the lever 19 is coupled to a follower member for adjusting the pivot angle of the lever 19 and therefore the relative position of the shield member 18*b* with respect to the notch 12*b*.

The follower member, as part of the actuating drive, comprises a first pivot arm 40 and a second pivot arm 44 mounted on a shaft 42. The shaft 42 is pivotally mounted on the carrier 45 and the center line of the shaft 42 defines the second axis B. As best seen in FIG. 4, the second pivot arm 44 engages with the second portion 19" of the lever 19 through a slide contact connection. A pin 41 on the second pivot arm 44 engages with a slot 31 on the second portion of the lever 19 so as to transmit angular motion.

The actuating drive further comprises a guide member 50 mounted on the shaft 46 so as to be slidable in axial direction. As indicated with the double arrow in FIG. 5, the guide member 50 can be moved up and down along the shaft 46. The axial position of the guide member 50 is adjusted by a crank drive mechanism. The crank drive includes a rotary drive 30, for example a servo drive, connected to a crank arm 28. The crank arm 28 is connected to the guide member 50, such that a rotational position of the rotary drive 30 precisely determines the axial position of the guide member 50 on the shaft 46.

An outer peripheral surface 52 of the guide member 50 is provided with an inclination in the axial direction of the axis A, which can best be seen in FIG. 5. In the present embodiment, the radial dimension of the surface 52 decreases from top to bottom as shown in the embodiment of FIG. 5. As can also be seen in the figures, the inclined surface 52 has an angular extension to account for the angular range of motion of the tuft picker.

A roller 48 is attached to the first pivot arm 40 so as to engage the inclined surface 52. Depending on the axial position of the guide member 50, the roller 48 engages a different portion of the inclined surface 52. As a result, the first pivot arm 40 is deflected by a certain pivot angle depending on the position at which the roller 48 engages the inclined surface 52. In the condition shown in FIG. 5, the roller engages a lower region of the inclined surface 52, such that the deflection or pivot angle of the first pivot arm 40 is small. In the condition shown in FIG. 4, the guide member 50 has been lowered toward the tuft picker 10*b* and the roller 48 engages the top or higher region of the inclined surface 52. The pivot angle of the first pivot arm 40 is correspondingly larger.

As can be taken from the above, a rapid and reliable adjustment stroke can be applied to the shield member. By controlling the rotary drive 30, for example with a step motor, the guide member with its inclined surface 52 can be precisely set in axial direction. Consequently, the pivot angle of the follower member is reliably set along with the pivot angle of the lever. As a result, the relative position of the shield member with respect to the notch is defined.

The invention claimed is:

1. A tuft picking device for a brush making machine, comprising a bristle magazine for holding a supply of loose bristles in a mutually parallel condition, a tuft picker including a tuft picking notch having an effective depth being movable in a working stroke past an open side of said bristle magazine, at least one shield member adapted to be shifted across the tuft picking notch to vary the effective depth of said notch, and an actuating drive coupled to the shield member and adapted to adjust the shield member in each working stroke, so as to vary the effective depth of said notch and thereby vary the size of a tuft engaged in the tuft picking notch, wherein a lever is provided to be pivotally mounted on said tuft picker, a first portion of which forms said shield member for varying the depth of said notch and a second portion of which is coupled to said actuating drive.

2. The tuft picking device of claim 1, wherein the tuft picker is pivoted about a first axis and the actuating drive comprises a follower member pivotally mounted about a second axis on said tuft picker.

3. The tuft picking device of claim 2, wherein the follower member comprises a first and a second pivot arm, the pivot arms being fixedly secured to said second axis and the second pivot arm being coupled to the second portion of said lever.

4. The tuft picking device of claim 3, wherein the actuating drive comprises a guide member slideably mounted along said first axis, the guide member arranged to engage said follower member.

5. The tuft picking device of claim 4, wherein the guide member comprises a peripheral surface inclined in the axial direction of said first axis and wherein the follower member comprises a roller mounted on said second pivot arm and arranged to engage said inclined surface, the axial position of the guide member along the first axis determining the pivot angle of the follower member and thus the pivot angle of the lever.

6. The tuft picking device of claim 5, wherein the actuating drive further comprises a crank drive coupled to the guide member for setting the axial position of the guide member on the first axis.

7. The tuft picking device of claim 2, wherein the follower member is pivotally mounted on said carrier about a second axis.

8. The tuft picking device of claim 1, wherein the tuft picker comprises a circular arc segment mounted on a carrier to be pivotal about a first axis.

9. A tuft picking device for a brush making machine, comprising a bristle magazine for holding a supply of loose bristles in a mutually parallel condition, a tuft picker including a tuft picking notch having an effective depth being movable in a working stroke past an open side of said bristle magazine, at least one shield member adapted to be shifted across the tuft picking notch to vary the effective depth of said notch, and an actuating drive coupled to the shield member and adapted to adjust the shield member in each working stroke, so as to vary the effective depth of said notch and thereby vary the size of a tuft engaged in the tuft picking notch, wherein said actuating drive comprises a follower member pivotally mounted on said tuft picker, said follower member being coupled to said shield member to adjust its position relative to said notch.

10. The tuft picking device of claim 9, wherein said tuft picker is pivoted about a first axis and said actuating drive comprises a guide member slideably mounted along said first axis, the guide member engaging said follower member.

11. The tuft picking device of claim 10, wherein the guide member comprises a peripheral surface inclined in the axial direction of said first axis and wherein said follower member is pivoted about a second axis and comprises a roller arranged to engage the inclined surface, the axial position of the guide member along with its inclined surface determining the pivot angle of the follower member.

12. The tuft picking device of claim 11, wherein the follower member comprises a first pivot arm with said roller mounted thereon and a second pivot arm, the pivot arms being fixedly secured to said second axis and the second pivot arm being coupled to said shield member.

13. The tuft picking device of claim 12, wherein a lever is pivotally mounted on said tuft picker, a first portion of which forms said shield member and a second portion of which is coupled to said second pivot arm.

14. The tuft picking device of claim 13, wherein the second portion of said lever comprises a slot arranged to engage with a pin mounted on said second pivot arm for transmitting angular motion.

15. The tuft picking device of claim 10, wherein the actuating drive further comprises a crank drive coupled to the guide member for setting the axial position of the guide member along the first axis.

16. The tuft picking device of claim 9, wherein the tuft picker comprises a circular arc segment mounted on a carrier to be pivotal about a first axis.

17. The tuft picking device of claim 16, wherein the follower member is pivotally mounted on the carrier about a second axis.

* * * * *